US005128547A

United States Patent [19]

Pfaff

[11] Patent Number: 5,128,547

[45] Date of Patent: Jul. 7, 1992

[54] ELECTRODE FOR CREATING CORONA

[76] Inventor: Ernest H. Pfaff, 1549 Woodvale Ave., Deerfield, Ill. 60015

[21] Appl. No.: 671,542

[22] Filed: Mar. 19, 1991

Related U.S. Application Data

[63] Continuation-in-part of Ser. No. 461,334, Jan. 5, 1990, Pat. No. 5,019,709.

[51] Int. Cl.[5] ..... H01T 19/04

[52] U.S. Cl. ..... 250/324; 361/225

[58] Field of Search ..... 250/324; 361/225, 231; 355/263

[56] References Cited

U.S. PATENT DOCUMENTS

| | | | |
|---|---|---|---|
| 3,348,041 | 10/1967 | Rosenthal | 250/324 |
| 3,966,436 | 6/1976 | Archer | 55/147 |
| 4,389,225 | 1/1983 | Willett et al. | 55/122 |
| 4,693,869 | 9/1987 | Pfaff | 313/243 |
| 4,772,788 | 9/1988 | Tsutsui | 250/324 |

*Primary Examiner*—Bruce C. Anderson

*Attorney, Agent, or Firm*—Lee, Mann, Smith, McWilliams, Sweeney & Ohlson

[57] ABSTRACT

An electrode for creation of a corona over an area. The electrode includes a corona driving portion and a corona emitting portion in electrical contact with the corona driving portion. The corona driving portion is much larger in size than the corona emitting portion such that corona from the electrode is emitted from the corona emitting portion in a direction away from the corona driving portion. The corona emitting portion includes a spiral wound wire extending from an edge of the corona driving portion to an inner terminus, the wire being spaced from the driving portion at an increasingly greater distance from the outer edge of the corona driving portion to the inner terminus.

11 Claims, 1 Drawing Sheet

ELECTRODE FOR CREATING CORONA

RELATED APPLICATION

This application is a continuation-in-part of U.S. patent application Ser. No. 461,334, filed Jan. 5, 1990 now U.S. Pat. No. 5,019,709.

BACKGROUND OF THE INVENTION

This invention relates to creation of electrical coronas, and in particular to an electrode for creation of a corona for surface treating desired areas of plastics and other materials.

As explained in my U.S. Pat. No. 4,693,869, the disclosure of which is incorporated herein by reference, many plastics, when molded, will not accept an adhesive, a coating, or inks or other printing vehicles unless the surface of the plastic has been chemically and/or physical altered. My patent discloses an electrode arrangement for creating a corona for treating such surfaces to accept adhesives, coatings, inks or other materials applied to the surface. One form of that patent pertains to a disk-like electrode which is able to create a corona in an annular fashion only because a corona will not be emitted from any portion other than the outer periphery of the electrode, thus leaving a circular central area without any treating corona.

My U.S. Pat. No. 4,924,092, the disclosure of which is also incorporated herein by reference, is directed to a unique system for creating a uniform corona over a predetermined volume of free space, so that surfaces of a plastic or similar material can be treated on all sides at one time, rather than on only a single side. In both referenced patents, a high frequency electric corona generator is used to generate resonate frequencies on the order to 2 MHz and above.

In my U.S. patent application Ser. No. 461,334, filed Jan. 5, 1990, the disclosure of which is also incorporated herein by reference, I disclose a particular form of electrode arrangement for creating corona over an area, using a disk-like electrode which has a series of spaced concentric rings, each of which creates a corona, thus providing an electrode which provides a corona over an area, rather than only an annular ring.

SUMMARY OF THE INVENTION

The present invention provides an improved electrode for creation of a corona. The electrode is configured to be attached to an appropriate electrical corona generator and is made of an electrically conductive material, such as aluminum or any other suitable metal or metallic compound. The electrode is formed for creation of a corona over an area to be treated, and includes a stem for attachment to the corona generator, a corona driving portion secured to the stem, and a corona emitting portion in electrical contact with the corona driving portion. The corona driving portion is greater in size than the corona emitting portion such that the corona emitted from the electrode is emitted essentially from the corona emitting portion in a direction away from the corona driving portion. To cover an entire area being treated, the corona emitting portion includes a spiral emitting element extending inwardly from an outer edge of the corona driving portion to an inner terminus, the emitting element having an emitting extremity spaced from the driving portion at an increasingly greater distance from the outer edge to the inner terminus.

In accordance with one form of the invention, the corona emitting portion also includes an outer ring at the outer edge, the emitting element extending from the ring. It is preferred that the distance that the emitting extremity is spaced from the driving portion increases essentially linearly from the outer edge to the inner terminus. In another form, the corona driving portion is flat, and emission occurs from a sharp edge of the corona driving portion.

In accordance with the disclosed forms the of invention, the emitting element comprises a spiral wound wire. The wire includes a corona tip at the terminus, the tip comprising a part of the wire and extending essentially perpendicular to the corona driving portion. The length of the tip can be varied in order to increase or decrease the amount of corona emitted from the tip, and thus the intensity of corona at the center of the electrode.

BRIEF DESCRIPTION OF THE DRAWING

The invention is described in greater detail in the following description of an example embodying the best mode of the invention, taken in conjunction with the drawing figures, in which.

DESCRIPTION OF EXAMPLES EMBODYING THE BEST MODE OF THE INVENTION

Figure 1:
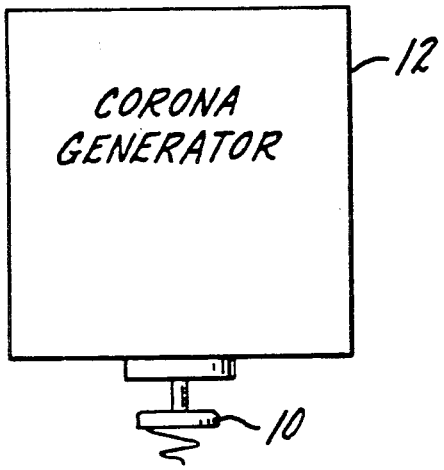
FIG. 1 is a schematic illustration of the electrode according to the invention in conjunction with a corona generator.

Illustrated in all drawing figures is an electrode 10 according to the invention. The electrode 10 is shown installed in FIG. 1 within a corona generator 12. As disclosed in referenced U.S. Pat. No. 4,924,092, a second electrode may be employed in registration with the first electrode 10, the second electrode being installed within a resonator coil. For the purposes of description and illustration, as well as many uses for treating, the second electrode and resonator coil have been omitted as unnecessary.

The corona generator 12 can be any readily available high voltage, high frequency corona generator, such as the BD-80 Surface Treater manufactured by Electro-Technic Products, Inc., Chicago, Illinois. The BD-80 Surface Treater will optimally operate at 250 kv at a frequency of 2 MHz. Other suitable corona generators can be employed, and the invention is not limited to any particular type of corona generator nor any specific value of voltage or frequency generated by the corona generator, so long as a corona can be generated from the electrode 10.

Figure 2:
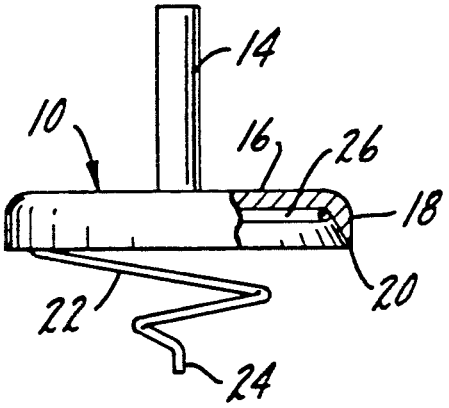
FIG. 2 is an enlarged elevational illustration of the electrode according to the invention, partially in cross section to show the internal structure.
Figure 3:
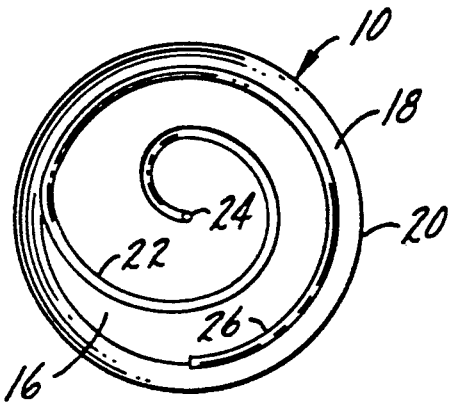
FIG. 3 is a bottom plan view of the electrode shown in FIG. 2.

As shown in FIGS. 2 and 3, the electrode 10 is composed of a stem 14 attached to a disk-like corona driving element 16. An annular corona emitting element 18 extends from the corona driving element 16 as shown. The corona emitting element 18 is in the form of a ring, and tapers to an edge or extremity 20 from which corona is emitted.

The corona emitting portion of the invention also includes a spiral emitting element 22 in the form of a wire which extends inwardly (toward the center of the electrode 10) from the ring 18 to an inner terminus or tip 24. As best shown in FIG. 2, the terminus 24 is an extended portion of the wire element 22, and extends essentially perpendicular to the corona driving element 16. The length of the terminus will determine the intensity of corona generated from the center of the electrode 10. If there is little or no downwardly extending portion of the wire element 22, then corona emitted by the electrode 10 is essentially uniform over an area. However, as the terminus 24 is extended, the intensity of the corona at that location increases. Thus, by judicious formation of the wire element 22, the intensity of the emitted corona can be altered accordingly.

Preferably, the distance that the wire element 22 is spaced from the corona driving element 16 increases linearly from the ring 18 to the terminus or tip 24. If the distance does not increase essentially linearly, then the intensity of the corona may vary. Also, the wire element 22 is wound in a spiral fashion with sufficient turns so that there also is adequate distribution of corona across the entire bottom area of the electrode 10, emitted downwardly (FIG. 2) from the corona driving element 16.

As seen in relation to FIG. 2, corona is emitted from the bottom of the wire element 22. which is the extremity of the wire at any given position from the corona driving element 16. Rather than being in the form of a wire, the corona emitting element 22 can also be a spiral element extending from the corona driving element 16 with its extremities being located at the location of the wire element 22. Other forms of corona emitting element, other than a wire, can also be employed so long as the outer extremity of the emitting element falls in the spiral pattern described.

The element 22 can be secured in any conventional manner to the remainder of the electrode 10. For example, it can be welded to the corona driving element 16 and/or the ring 18. Alternatively, the element 22 can include a circular extended portion 26 which abuts the base of the ring 18, with a channel or the like (not illustrated) being formed in the electrode 10 at the juncture of the ring 18 and corona driving element 16 to accommodate and secure the extended portion 26.

As explained in referenced application Ser. No. 461,334, any portion of the wire element 22 extending beneath the extremity or edge 20 (that is, being located between the edge 20 and the underside of the corona driving element 20) will not emit a corona. Thus, for uniform corona emission it is essential that the wire element 22 extend outwardly from the corona driving element 16 as illustrated.

It is preferred that the wire element 22 be made of spring wire or a similar material so that the electrode 10 can be used for close and intensive treating of a plastic surface. For example, by pressing a material to be treated against the tip 24, the wire element 22 can be compressed into the area bounded by the ring 18. As the wire element 22 is compressed in this manner, corona emitted from the extremity or edge 20 increases in intensity as corona from portions of the wire element 22 is extinguished, until the wire element 22 is fully collapsed, and essentially all corona is emitted from only the edge or extremity 20.

Figure 4:
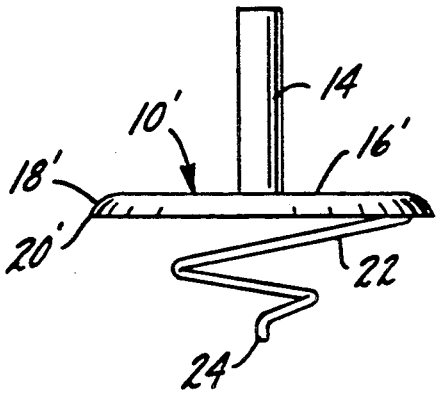
FIG. 4 is an elevational illustration of a second form of electrode according to the invention.

A second form of the invention is shown at 10' in FIG. 4. Since this form is essentially identical, like elements bear the same reference numerals. In this form of the invention, the corona driving element 16' is a flat, solid disk, terminated at its periphery with an outer ring-like area comprising a corona emitting element or portion 18' which tapers to an edge or extremity 20' from which corona is emitted. The wire element 22 remains as in the first form of the invention, and may be affixed as desired to the element 18'. If the element 22 includes the extended portion 26, the extended portion 26 would be embedded in a channel (not illustrated) suitably formed in the bottom of the element 16'. The element 16' would otherwise be solid, and does not have any downwardly directed part, such as the emitting element 18 of FIGS. 2 and 3. This form of the invention is particularly useful in treating the insides of cylinders having closed bottoms, where the electrode 10' is inserted within the cylinder.

Various changes can be made to the invention without departing from the spirit thereof or scope of the following claims.

What is claimed is:

1. An electrode for creating a corona over an area, the electrode being configured for attachment to a high frequency generator and being made of an electrically conductive material, and comprising a. a stem for attachment to a corona generator, b. a corona driving portion secured to said stem, c. a corona emitting portion in electrical contact with said corona driving portion, d. said corona driving portion being greater in size than said corona emitting portion such that corona from the electrode is emitted essentially from said corona emitting portion in a direction away from said corona driving portion, and e. said corona emitting portion including a spiral emitting element extending in convolutions in a decreasing helix inwardly from an outer edge of said corona driving portion to an inner terminus, said convolutions being spaced from one another, and said emitting element having an emitting extremity spaced from said driving portion at an increasingly greater distance from said outer edge to said inner terminus.

2. An electrode according to claim 1 in which said distance increases essentially linearly from said outer edge to said inner terminus.

3. An electrode according to claim 1 in which said corona emitting portion includes an outer ring at said outer edge, said emitting element extending from said ring.

4. An electrode according to claim 3 in which said ring includes a taper to a corona emitting extremity.

5. An electrode according to claim 4 in which said extremity extends perpendicular to said corona driving element.

6. An electrode according to claim 4 in which said extremity extends outwardly from said corona driving element.

7. An electrode according to claim 1 in which said emitting element comprises a spiral wound wire.

8. An electrode according to claim 7 in which said wire includes a corona tip at said terminus.

9. An electrode according to claim 8 in which said tip comprises a part of said wire extending essentially perpendicular to said corona driving portion.

10. An electrode according to claim 1 in which said emitting element includes a corona tip at said terminus.

11. An electrode according to claim 10 in which said tip extends essentially perpendicular to said corona driving portion.

* * * * *